United States Patent [19]

Powers

[11] Patent Number: 4,987,911

[45] Date of Patent: Jan. 29, 1991

[54] COSMETIC PENCIL

[76] Inventor: Ronald J. Powers, 550 E. Third St., Unit B, Oxnard, Calif. 93030

[21] Appl. No.: 379,185

[22] Filed: Jul. 13, 1989

[51] Int. Cl.[5] ..... A45D 40/26

[52] U.S. Cl. ..... 132/320; 401/67; 401/68; 401/75; 132/218

[58] Field of Search ..... 132/216, 218, 320; 401/67, 68, 75

[56] References Cited

U.S. PATENT DOCUMENTS

| | | | |
|---|---|---|---|
| 250,537 | 12/1881 | Hoffman | 401/75 |
| 1,518,822 | 12/1924 | Saadi | 401/75 |
| 1,900,669 | 3/1933 | Sheaffer et al. | 401/75 |
| 2,072,922 | 3/1937 | Norlin | 401/75 |
| 2,186,869 | 1/1940 | Kahn | 401/68 |
| 2,491,723 | 12/1949 | Gelardin | 401/68 |
| 3,219,044 | 11/1965 | Bau | 401/75 |
| 3,408,147 | 10/1968 | Bleuer | 401/65 |
| 3,468,612 | 9/1969 | Ashton | 132/320 |
| 3,768,915 | 10/1973 | Spatz | 132/320 |
| 4,218,153 | 8/1980 | Hasimoto | 401/67 |
| 4,221,490 | 9/1980 | Malm | 401/75 |
| 4,269,524 | 5/1981 | Hashimoto et al. | 401/67 |
| 4,544,296 | 10/1985 | Jarvis et al. | 401/75 |
| 4,696,594 | 9/1987 | Powers | 401/65 |

FOREIGN PATENT DOCUMENTS

| | | | |
|---|---|---|---|
| 0459753 | 9/1949 | Canada | 132/320 |

*Primary Examiner*—John J. Wilson
*Assistant Examiner*—F. LaViola
*Attorney, Agent, or Firm*—Edgar W. Averill, Jr.

[57] ABSTRACT

A cosmetic pencil capable of advancing a soft cosmetic mass a short predetermined distance. The pencil has a lower barrel which includes a gripping disk stop. A hollow sheath member is held in the lower barrel and has an outwardly facing cam surface. A holding tube is rotatably inserted into the lower barrel and surrounds the sheath member. The holding tube also has a cam surface, and a spring member and gripping disk surround a push rod which extends into the center portion of the sheath which holds the soft cosmetic mass. Turning the holding tube forces the sheath inwardly, and the gripping disk holds the push rod steady with respect to the lower barrel and, thus, a small amount of cosmetic mass is moved upwardly by the movement of the sheath with respect to the push rod.

14 Claims, 4 Drawing Sheets

COSMETIC PENCIL

BACKGROUND OF THE INVENTION

The field of the invention could broadly be considered writing instruments, although the use of the crayon portion of the device of the present invention is typically for cosmetic uses such as for an eyebrow pencil.

Applicant's earlier U.S. Pat. No. 4,696,594, describes the background and use of the cosmetic pencil of the present invention. Although this pencil was a substantial improvement over most prior art cosmetic pencils, it had several shortcomings. In use, the sheath member was turned, and since this had a relatively small diameter, this turning action was somewhat difficult. Also, a push head cylinder was required to assist in the outward movement of the cosmetic mass.

SUMMARY OF THE INVENTION

It is an object of the present invention to provide a particularly easy-to-use cosmetic pencil.

The present invention is for a cosmetic pencil capable of advancing a soft cosmetic mass a short, predetermined distance. The pencil has a lower barrel having a central axis and having a gripping disk stop member extending from the interior surface thereof. A hollow sheath member having an inner end and an outer end and having an inner cylindrical opening and an outer surface is held within the lower barrel. The sheath member extends outwardly from the lower barrel and includes means to limit the rotation between the lower barrel and the sheath member. The sheath member also has an outwardly facing cam surface located about its exterior surface. A spring element is positioned between the lower barrel and the sheath member and urges the sheath member outwardly with respect to the lower barrel. A hollow holding tube has an inner surface and an outer surface and is rotatably held in the lower barrel between the lower barrel and the sheath member. The holding tube has an inwardly facing cam surface which is adjacent the outwardly facing cam surface of the sheath member. A push rod has a cylindrical exterior surface and is held axially within the lower barrel and extends to the inner cylindrical opening of the sheath member and is movable therein. A cosmetic mass is held within the inner cylindrical opening of the sheath member and is extrudable therefrom by the further insertion of the push rod into said opening. A gripping disk has a central opening slightly larger than the exterior surface of the push rod. The gripping disk fits within the interior of the lower barrel and abuts the gripping disk stop of the lower barrel. Thus, when the holding tube is rotated with respect to the lower barrel and sheath member, the inwardly facing cam surface of the holding member moves the outwardly facing cam surface of the sheath member and the sheath member, itself, inwardly with respect to the lower barrel. This forces the gripping disk against the gripping disk stop causing it to bind against the push rod and hold it steady against the inwardly moving sheath member. This forces a small amount of the cosmetic mass outwardly from the sheath member, and the action is reset by the outward movement of the sheath member permitted by the abutting cam surfaces and urged by the spring element.

Preferably, the inner cylindrical opening of the sheath member includes a slightly narrowed portion which grips the push rod. A preferred method of limiting the rotation between the barrel and the sheath member is one or more ribs on the exterior of the sheath member and one or more ribs on the interior of the lower barrel. One form of the spring element has an inner ring and an outer ring and a recess between the rings, and the inner ring, preferably, extends inwardly a distance further than the outer ring. A second form of spring element is a helical spring. One benefit of combining a helical spring with a push rod of a length only slightly greater than the sheath is that the gripping disk will fall off the inner end of the push rod when all of the cosmetic mass has been extruded. This makes it very obvious to the user that the cosmetic pencil is empty. It also prevents any safety hazard of the push rod extending past the end of the pencil. Also a steep step cover is provided in a preferred embodiment on the cam surface. This prevents turning the pencil in a reverse direction and further provides an audible click when the pencil is turned.

DESCRIPTION OF THE PREFERRED EMBODIMENTS

Figure 1:
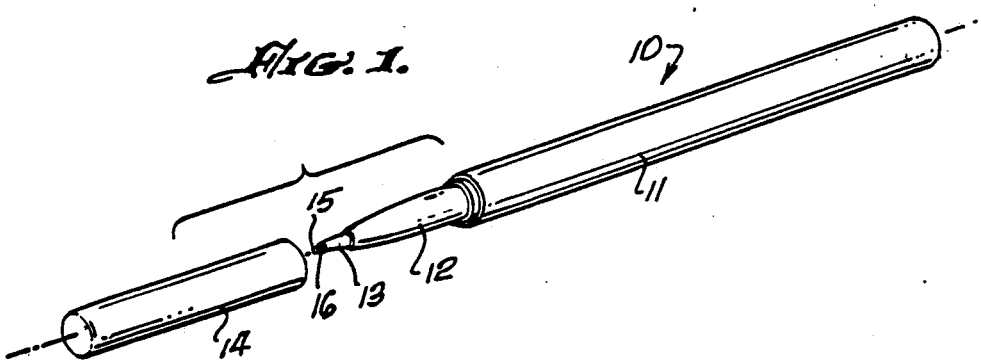
FIG. 1 is a perspective view showing the exterior of the cosmetic pencil of the present invention.

The cosmetic pencil of the present invention is shown in perspective view in FIG. 1 and indicated generally by reference character 10. Pencil 10 has a lower barrel 11, a holding tube 12, a sheath member 13 and a cap 14. A cosmetic mass 15 extends a short distance from the outer end 16 of sheath member 13.

Figure 2:
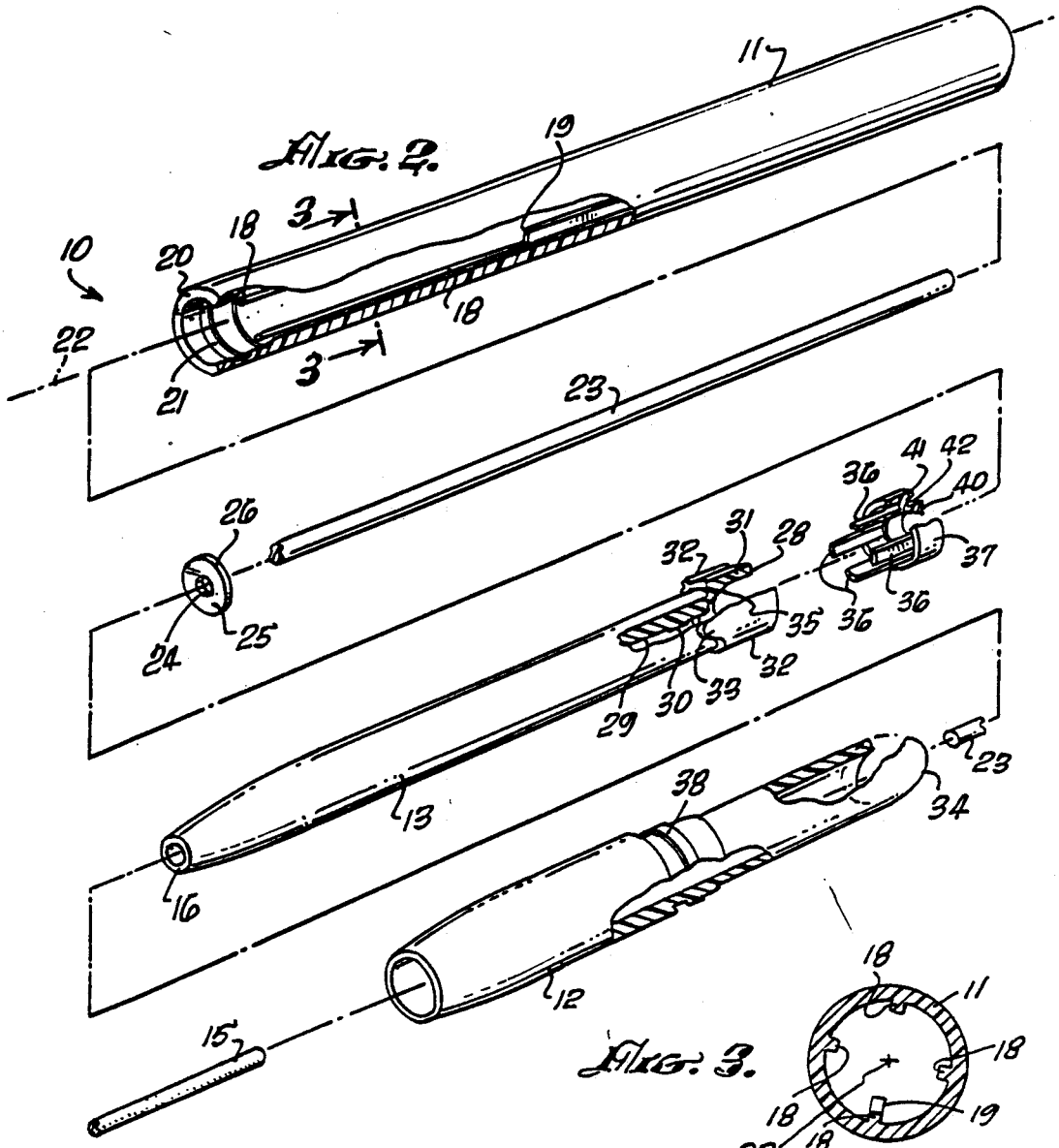
FIG. 2 is an exploded perspective view of the cosmetic pencil of FIG. 1.

The details of construction of cosmetic pencil 10 are shown best in the exploded perspective view of FIG. 2. There it can be seen that lower barrel 11 has an interior surface 17 with four ribs 18 extending inwardly therefrom. A gripping disk stop 19 extends inwardly a distance further than ribs 18 and abuts the gripping disk as shown more fully below. Lower barrel 11 has an open end 20 and a locking recess 21. The central axis of lower barrel 11 is indicated by reference character 22.

A push rod 23 is held axially within lower barrel 11 and is inserted through the central opening 24 in gripping disk 25. Central opening 24 is slightly larger than the outside diameter of push rod 23 which is conventional for such gripping disks. The outer surface 26 of gripping disk 25 fits within ribs 18 of lower barrel 11 but touches gripping disk stop 19 as shown best in FIG. 5.

A sheath member 13 has an outer end 16 and inner end 28. Sheath member 13 has an inner cylindrical opening 29 which is about the same size as push rod 23. Inner cylindrical opening 29 has, however, a push rod gripping area 30 which comprises a short length of reduced diameter as shown both in FIG. 2 and in FIGS. 4 and 5. This slightly reduced diameter grips the push rod and prevents it from moving rearwardly during the operation of the cosmetic pencil. Sheath member 13 also has an outwardly extending ring 31 which has a plurality of ribs 32 which interfere with ribs 18 and prevent the turning of the sheath member with respect to lower barrel 11. Ring 31 also has an outwardly facing cam surface 33 which rides along the cam surface 34 of holding tube 12. On the inner surface of outwardly extending ring 31 is a frusto-conical surface 35 which moves the fingers 36 on spring element 37 inwardly as spring element 37 is moved inwardly with respect to outwardly extending ring 31. These fingers are elastic and urge the sheath member outwardly and hold its outwardly facing cam surfaces 33 against the inwardly facing cam surfaces 34 of holding tube 12.

Holding tube 12 is held in lower barrel 11 by the insertion of locking ring 38 into locking recess 21.

Figure 3:
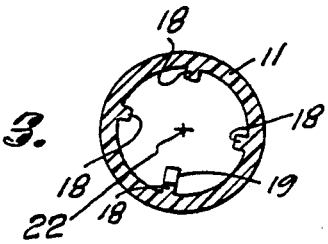
FIG. 3 is a cross-sectional view taken along line 3—3 of FIG. 2.

The lower barrel 11 is shown in cross-sectional view in FIG. 3. Four ribs 18 extend inwardly from interior surface 17. Gripping disk 19 extends inwardly a distance greater than ribs 18.

Figure 4:
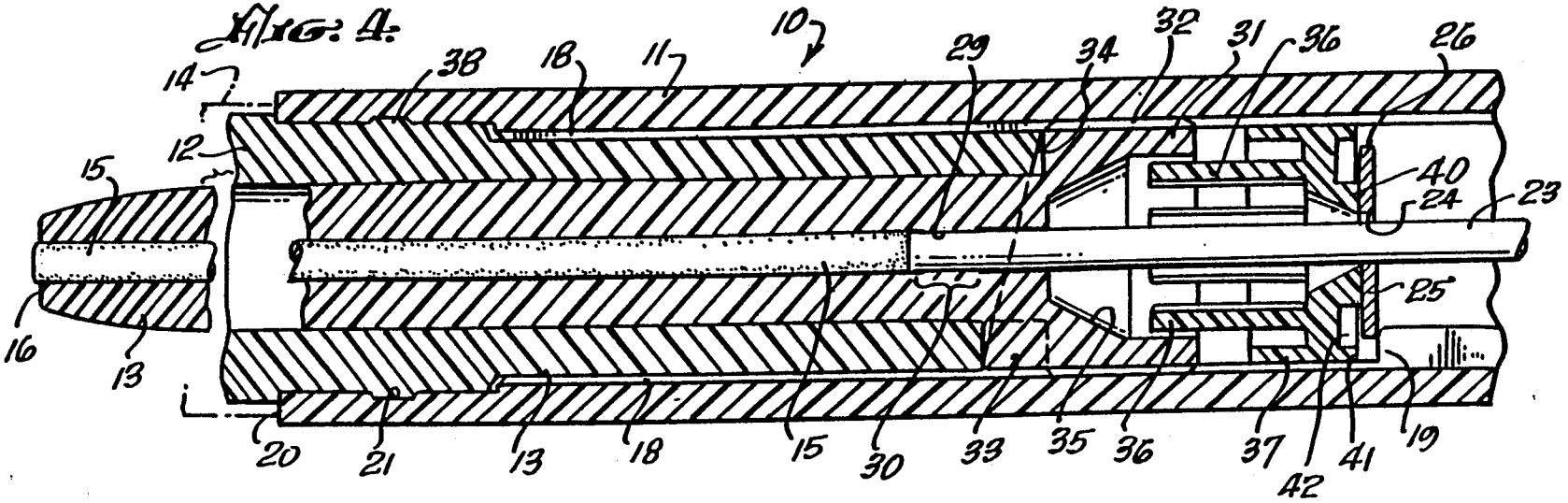
FIG. 4 is an enlarged cross-sectional view of the front of the cosmetic pencil of FIG. 1.
Figure 5:
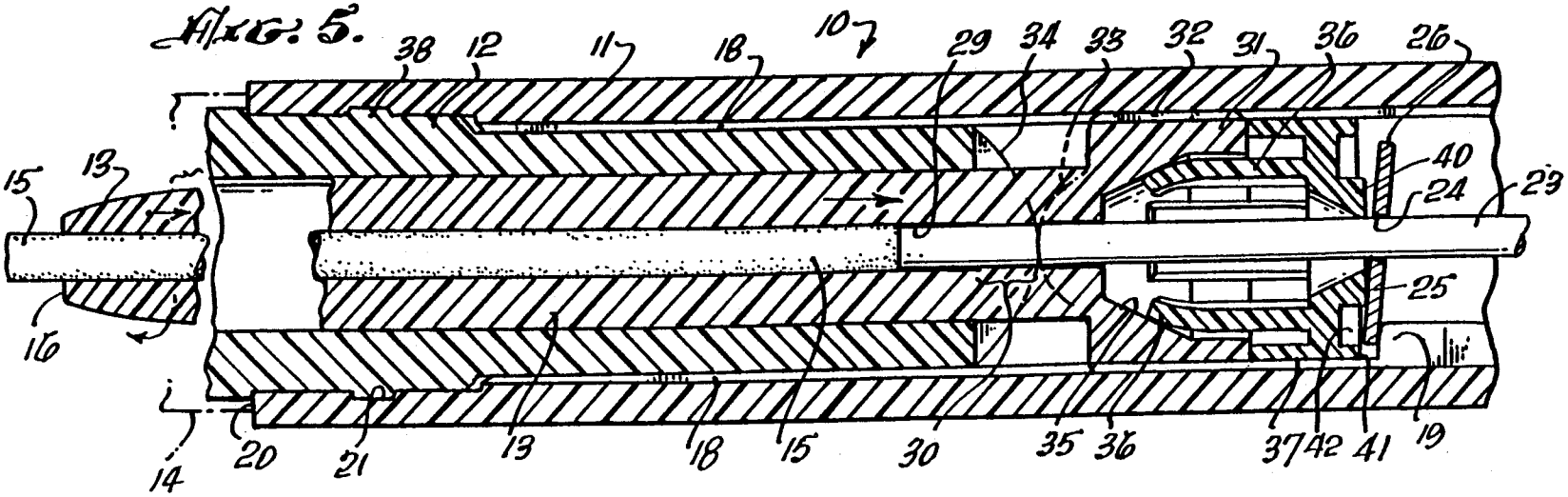
FIG. 5 is an enlarged cross-sectional view analogous to FIG. 4 but showing the holding member turned 90° with respect to its position shown in FIG. 4.
Figure 6:
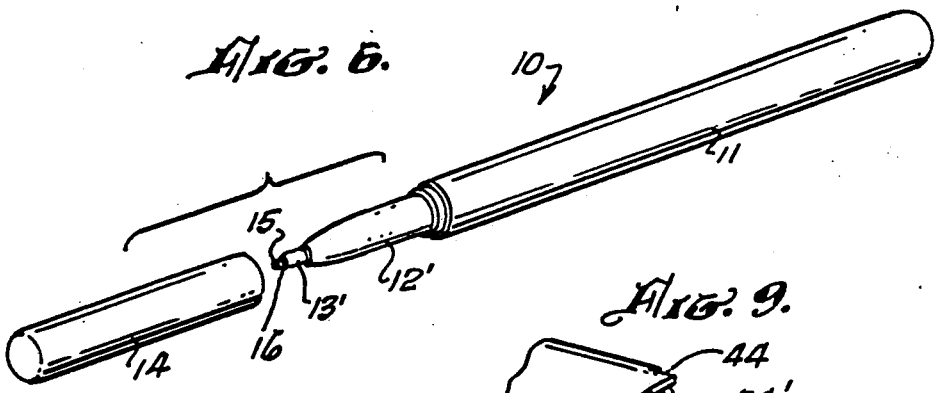
FIG. 6 is a perspective view showing the exterior of an alternate embodiment of the cosmetic pencil of the present invention.

The operation of the movement of the cosmetic mass is shown best in FIGS. 4 and 5. There it can be seen that the ribs 18 on the interior surface 17 of lower barrel 11 contact the ribs 32 of sheath member 13. Thus, although a 90 degree rotation can be made between the sheath member 13 and the outer barrel 11, these ribs then contact one another and prevent the sheath from simply turning within inner barrel 11. Thus, as holding tube 12 is turned, as soon as ribs 32 of the sheath member contact the ribs 18 of the outer barrel, the sheath stops turning and the inwardly facing cam surface 34 of the holding member moves with respect to the outwardly facing cam surface on the sheath member thereby moving the sheath member inwardly with respect to the barrel. This causes the inner ring 40 of spring element 37 to contact the gripping disk 25 and force it against the gripping disk stop 19 thereby binding its central opening 24 against the push rod 23 holding it with respect to the outer barrel and thereby forcing it inwardly with respect to the sheath member. This, of course, forces a certain amount of the cosmetic mass 15 out past the outer end 16 of the sheath and permits it to be used. It should be noted that the inner ring 40 extends further into lower barrel 11 than outer ring 41. This increases the binding of gripping disk 25 with push rod 23, and a recess 42 between rings 40 and 41 permit the disk 25 to tilt, as shown in FIG. 5, as it abuts gripping disk stop 19. The amount of cosmetic mass extruded in FIG. 5 is exaggerated for purposes of illustration, and it is highly beneficial that only a small amount is extended so that it may be used without breaking since the cosmetic mass is inherently a very soft breakable material. It can also be seen in FIG. 5 that fingers 36 of spring element 37 are forced inwardly by contact with the frusto-conical surface 35. Since these fingers are elastic, they are urged outwardly and thereby force the sheath 13 outwardly and hold the outwardly facing cam surface 33 against the inwardly facing cam surface 34 preparing it for another rotation. Further, the gripping area 30 pulls the push rod 23 and prevents it from moving downwardly as the elements are returned to the position shown in FIG. 4. This gripping area should be relatively short so that the friction of movement of the push rod into the inner cylindrical opening 29 of the sheath member 13 is not increased as it is further inserted therein. The diameter of the inner cylindrical opening 29 is only slightly larger in inside diameter than the outside diameter of the sleeve. In this way, essentially all of the cosmetic mass is extruded and no separate cylinder is required.

It should be noted that one could widen locking recess 21 and operate the pencil by moving holding tube 12 rearwardly into lower barrel 11. It has been found, however, that the public has a tendency to turn the barrel rather than pushing it inwardly.

The elements of the present invention are fabricated from a polymer except for the push rod and gripping disk which are metal.

The result of these elements is that the cosmetic pencil 10 can be easily operated by turning holding tube 12 with respect to lower barrel 11. Because holding tube 12 is relatively large in diameter, as is holding barrel 11, this turning action is easy, even if the user's fingers are wet. It is also possible to make only a portion of a turn to extrude even a lesser amount of the cosmetic mass. The release of the holding tube with respect to the lower barrel permits spring element 37 to return the tube cam surfaces to their position as shown in FIG. 4.

Figure 8:
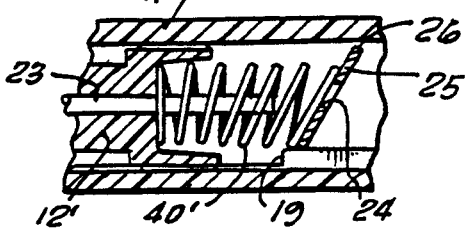
FIG. 8 is a cross-sectional view showing the end of the push rod of the cosmetic pencil of FIG. 6.

The alternate embodiment of cosmetic pencil 10 is shown in FIGS. 6 through 11. This pencil, like the pencil shown in FIGS. 1 through 5, is indicated by reference character 10 and has a lower barrel 11, a holding tube 12', a sheath 13', a cap 14 and a cosmetic mass 15. In the exploded, perspective view of FIG. 7, it can be seen that in place of the spring element 37, a helical spring 40' is used. This provides additional movement and flexibility in that its biasing action is more even and exerted over a longer length than spring element 37. One benefit of this additional movement is indicated in FIG. 8 of the drawings. When the outer end 41 of push rod 23 reaches the front 43 of sheath 13', the gripping disk 25 is pushed rearwardly as shown in FIG. 8 since it is no longer restrained by the contact between its central opening 24 and the exterior surface of push rod 23. This has two significant advantages. First of all, it causes the holding tube 12' to turn freely with respect to lower barrel 11, thus advising the user that the contents of the cosmetic pencil have been completely used. This free movement results from the fact that the helical spring 40' no longer forces the cam surface 33' of sheath 13' against the cam surface 34' of the holding tube 12'. Thus, the friction caused by the contact of these two cam surfaces is eliminated, and the rotation of movement between the holding tube and the lower barrel is markedly lower.

Another substantial advantage of the removal of the gripping disk 25 from the push rod 23 is that any further movement of the push rod 23 out of the sheath 13' is eliminated. Thus, the push rod cannot be forced outwardly to cause a potential safety hazard.

Another substantial design change between the cosmetic pencil of FIGS. 6 through 11 is present in cam surface 34' of holding tube 12' and cam surface 33' of sheath 13'. It can be seen best in FIGS. 7 and 9 that the cam surface 34' has a pair of steep steps 44 and 45 and a single protrusion 46 on cam surface 33'. It can easily be visualized that as holding tube 12' is rotated with respect to sheath 13', that protrusion 46 will ride upwardly along the cam surface 34' until it reaches the steep step 44 or the steep step 45. At that point, protrusion 46 will be forced outwardly with respect to holding tube 12' by helical spring 40', thus causing a noticeable clicking noise. In addition to the audible response to a 180° turning of the holding tube with respect to the lower barrel, this also prevents the reverse turning of the holding tube with respect to the lower barrel. Users sometimes have a tendency to think that by turning lower barrel 11 in a counterclockwise direction with respect to holding tube 12', that the cosmetic mass will retract into the sheath. This, clearly, is not the case and with the design shown in FIGS. 1 through 5, the reverse turning just further extrudes the cosmetic mass. By preventing the counterclockwise turning of the holding tube versus the barrel, this inadvertent additional extrusion is eliminated.

Figure 10:
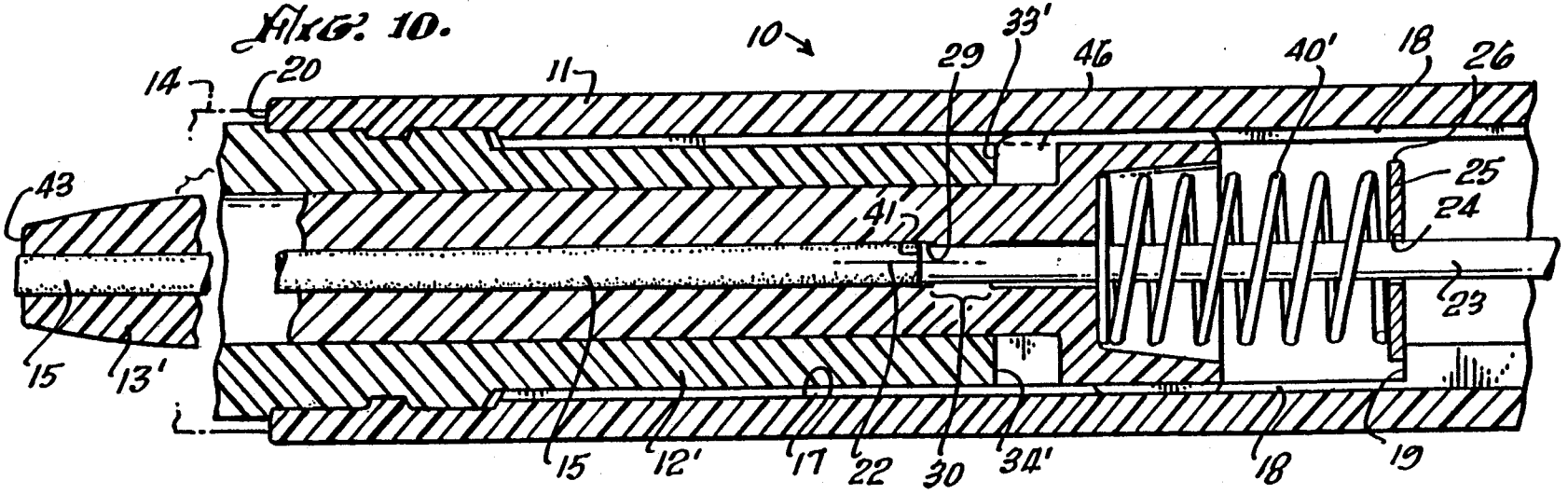
FIG. 10 is an enlarged cross-sectional view of the front and mid portion of the cosmetic pencil of FIG. 1.
Figure 11:
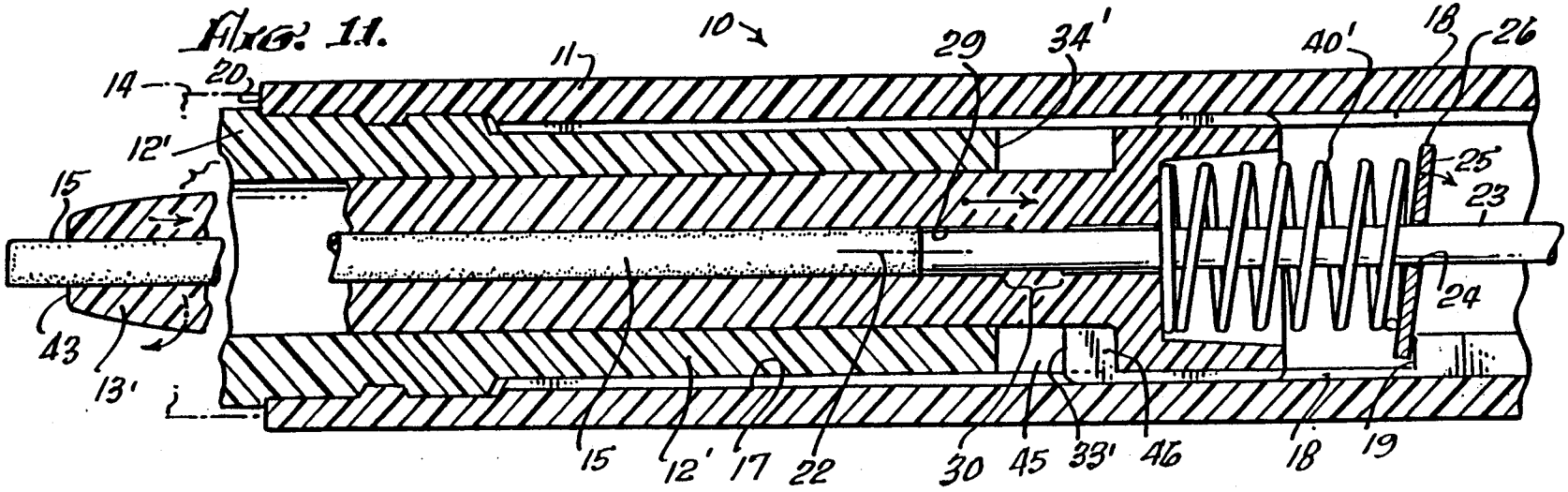
FIG. 11 is an enlarged cross-sectional view analogous to FIG. 10 but showing the holding member having been turned 90° with respect to its position shown in FIG. 10.

The movement of the sheath and holding tube is shown best by comparing FIGS. 10 and 11. As the holding tube 12' is turned with respect to barrel 11, the projection 46 rides up along the cam surface 34' moving the sheath into the interior of lower barrel 11. Since the push rod is held by the binding of the central opening 24 of the gripping disk 25, it remains fixed with respect to lower barrel 11, thus causing the cosmetic mass 15 to be extruded from the front 43 of sheath 13' as shown in FIG. 11. The further turning of the barrel and holding tube causes the protrusion 46 to reach the step 44 and, thus, rapidly moves the sheath 13' in a direction outwardly with respect to holding tube 12'. As set forth above, the counterclockwise turning of the holding tube and lower barrel is prevented by contact between protrusion 46 and step 44 or step 45.

Figure 9:
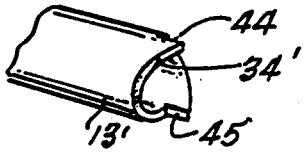
FIG. 9 is a perspective view of the cam surface of the holding tube of the cosmetic pencil of FIG. 6.
Figure 7:
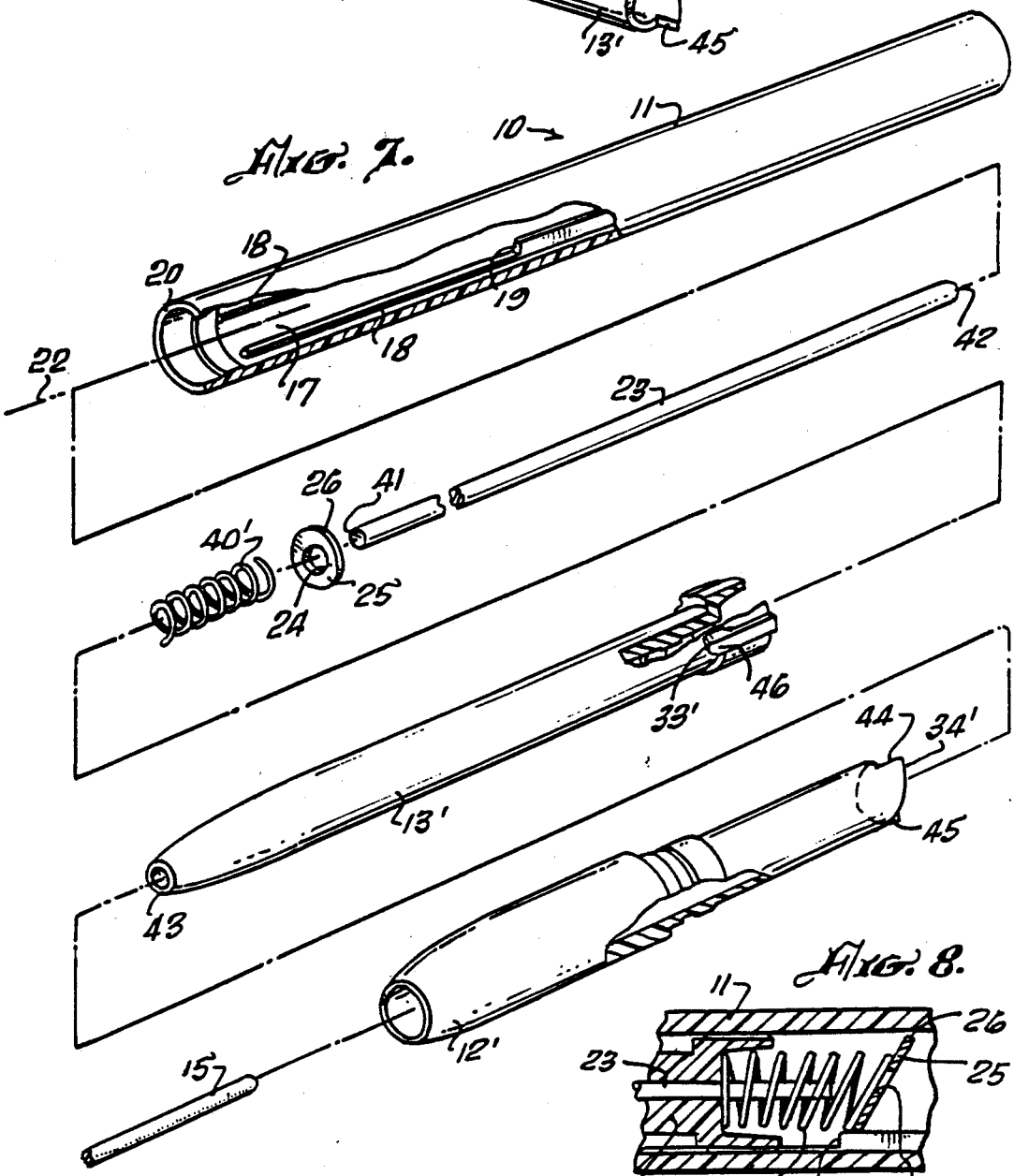
FIG. 7 is an exploded, perspective view of the cosmetic pencil of FIG. 6.

It is also possible instead of the steep step 44, which is essentially longitudinal with respect to holding tube 12', it can be formed at a slight angle which would permit the holding tube and barrel to be turned in either direction rather than in just one direction with the steep step as shown in FIG. 9. A slightly angled step of about 25° will still permit turning in either direction while providing an audible click.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A cosmetic pencil capable of advancing a soft cosmetic mass a short, predetermined distance, said pencil comprising:

a lower barrel having a central axis and said lower barrel having a hollow center with an interior surface and having a gripping disk stop member extending from the interior surface thereof;

a hollow sheath member having an inner end and an outer end and having an inner cylindrical opening including an inner end and an outer surface, said sheath member being held within said lower barrel to permit the rotation of the sheath member within the lower barrel, said sheath member extending outwardly from the lower barrel, said sheath member and said lower barrel including means to limit the rotation between the lower barrel and the sheath member, and said sheath member including an outwardly facing cam surface located around its outer surface;

a spring element positioned between said lower barrel and said sheath member urging said sheath member outwardly with respect to said lower barrel;

a hollow holding tube having an inner surface and an outer surface rotatably held in said lower barrel between said lower barrel and said sheath member and said holding tube having an inwardly facing cam surface adjacent said outwardly facing cam surface of said sheath member;

a push rod having a cylindrical exterior surface held axially within said lower barrel and extending into close contact with the inner cylindrical opening of said sheath member and movable into said cylindrical opening;

a cosmetic mass held within said inner cylindrical opening of said sheath member and extrudable therefrom by the insertion of the push rod into said opening; and a gripping disk having a central opening slightly larger than the exterior surface of said push rod and an exterior surface that fits within said interior surface of said lower barrel and abuts the gripping disk stop member of the lower barrel, said gripping disk also abutting said spring element, which spring element urges said gripping disk against said gripping disk stop, whereby when said holding tube is rotated with respect to said lower barrel and sheath member, the inwardly facing cam surface of the holding tube moves the outwardly facing cam surface of the sheath member and the sheath member itself inwardly with respect to the lower barrel, forcing the gripping disk against the gripping disk stop causing it to bind against the push rod and hold it steady against the inwardly moving sheath member thereby forcing a small amount of the cosmetic mass outwardly from the sheath member, and when the holding tube is further turned, the cam surface moves into a position permitting the spring element to push the sheath member outwardly positioning it for a later cycle.

2. The cosmetic pencil of claim 1 wherein the inner cylindrical opening of the sheath member includes a push rod gripping area.

3. The cosmetic pencil of claim 2 wherein said gripping area is a narrowed portion of the inner cylindrical opening of the sheath member.

4. The cosmetic pencil of claim 3 wherein said narrowed portion is located near the inner end of the inner cylindrical opening but at a point separated from the inner end of said opening.

5. The cosmetic pencil of claim 1 wherein said means to limit the rotation between the lower barrel and the sheath member comprises at least one rib on the outer surface of the sheath member and at least one rib on the interior surface of the lower barrel.

6. The cosmetic pencil of claim 5 wherein there are four ribs on the interior surface of the lower barrel and four ribs on the outer surface of the sheath member.

7. The cosmetic pencil of claim 1 wherein said spring element has an inner ring, and outer ring and a recess between these rings and wherein the inner ring extends inwardly into the lower barrel a distance further than the outer ring.

8. The cosmetic pencil of claim 1 wherein said spring element is a helical spring.

9. The cosmetic pencil of claim 1 wherein said inwardly facing cam surface includes a smoothly sloped cam surface terminating in a generally longitudinal step.

10. The cosmetic pencil of claim 9 wherein said outwardly facing cam surface of said hollow sheath member comprises a single outwardly facing protrusion.

11. A cosmetic pencil capable of advancing a soft cosmetic mass a short, predetermined distance, said pencil comprising:

a lower barrel having a central axis and said lower barrel having a hollow center with an interior surface and having a gripping disk stop member extending from the interior surface thereof and having at least one rib extending inwardly from its interior surface;

a hollow sheath member having an inner end and an outer end and having an inner cylindrical opening including a narrowed portion near the inner end of the opening to grip a push rod inserted therein and said sheath member having an outer surface, said sheath member being held within said lower barrel to permit the rotation of the sheath member within the lower barrel, said sheath member extending outwardly from the lower barrel, said sheath member and said lower barrel each including at least one rib, said at least one rib of said sheath member extending outwardly therefrom an amount sufficient to contact said at least one rib of said lower barrel to limit the rotation between the lower barrel and the sheath member, and said sheath member including an outwardly facing cam surface located around its outer surface;

a spring element positioned between said lower barrel and said sheath member urging said sheath member outwardly with respect to said lower barrel;

a hollow holding tube having an inner surface and an outer surface rotatably held in said lower barrel between said lower barrel and said sheath member and said holding tube having an inwardly facing cam surface adjacent said outwardly facing cam surface of said sheath member;

a push rod having a length and a cylindrical exterior surface held axially within said lower barrel and extending into close contact with the inner cylindrical opening of said sheath member and movable into said cylindrical opening, and said push rod being gripped by the narrowed portion within the inner cylindrical opening and said push rod being insertable into said inner cylindrical opening;

a cosmetic mass held within said inner cylindrical opening of said sheath member and extrudable therefrom by the insertion of the push rod into said opening; and a gripping disk having a central opening slightly larger than the exterior surface of said push rod and an exterior surface that fits within said interior surface of said lower barrel and abuts the gripping disk stop of the lower barrel, whereby when said holding tube is rotated with respect to said lower barrel and sheath member, the inwardly facing cam surface of the holding member moves the outwardly facing cam surface of the sheath member and the sheath member itself inwardly with respect to the lower barrel, forcing the gripping disk against the gripping disk stop causing it to bind against the push rod and hold it steady against the inwardly moving sheath member thereby forcing a small amount of the cosmetic mass outwardly from the sheath member and when the holding tube is further turned, the cam surface of the holding tube moves into a position permitting the spring element to push the sheath member outwardly positioning it for a later cycle.

12. The cosmetic pencil of claim 11 wherein said spring element is a helical spring and wherein said push rod has an inner end within said lower barrel and an outer end within said sheath, and the length of said push rod is such that the inner end of said push rod passes through said central opening of said gripping disk when the outer end of said push rod is adjacent the outer end of said hollow sheath member whereby said gripping disk is separated from said push rod resulting in the free turning of the lower barrel with respect to the holding tube.

13. The cosmetic pencil of claim 12 wherein the inwardly facing cam surface of said hollow holding tube has an angled cam surface including at least one steep, generally longitudinal step, and said angled cam surface is directed so that it permits the clockwise turning of the hollow holding tube with respect to the lower barrel as viewed from the end of the cosmetic pencil from which the sheath member extends from the lower barrel.

14. The cosmetic pencil of claim 13 wherein said inwardly facing cam surface of said hollow holding tube has a pair of opposed steps therein.

* * * * *